US010173306B2

(12) United States Patent
Chou

(10) Patent No.: US 10,173,306 B2
(45) Date of Patent: Jan. 8, 2019

(54) SECURING UNIT FOR SECURING ADAPTER TO WRENCH

(71) Applicant: POWAGRIP INDUSTRIAL CO., LTD., Taichung (TW)

(72) Inventor: Chin-Ying Chou, Taichung (TW)

(73) Assignee: Powagrip Industrial Co., Ltd., Taichung (TW)

( * ) Notice: Subject to any disclaimer, the term of this patent is extended or adjusted under 35 U.S.C. 154(b) by 96 days.

(21) Appl. No.: 15/347,800

(22) Filed: Nov. 10, 2016

(65) Prior Publication Data

US 2018/0126521 A1 May 10, 2018

(51) Int. Cl.
*B25B 23/00* (2006.01)
*B25B 13/46* (2006.01)

(52) U.S. Cl.
CPC ..... *B25B 23/0035* (2013.01); *B25B 13/461* (2013.01)

(58) Field of Classification Search
CPC ..... B25B 13/461
USPC ..... 81/60
See application file for complete search history.

(56) References Cited

U.S. PATENT DOCUMENTS 2,757,564 A * 8/1956 Reaves ..... B25B 13/463 81/58.2
6,516,689 B1 * 2/2003 Bates ..... B25B 13/463 81/58
6,752,046 B1 * 6/2004 Lee ..... B25B 13/461 81/177.85
6,871,570 B1 * 3/2005 Santillan ..... B25B 13/461 81/125
6,889,581 B2 * 5/2005 Chen ..... B25B 13/04 81/125
6,948,406 B1 * 9/2005 Li ..... B25B 13/461 81/60
9,010,220 B2 * 4/2015 Chen ..... B25B 23/0035 81/60
9,156,141 B2 * 10/2015 Chang ..... B25B 13/56
9,308,631 B2 * 4/2016 Shyu ..... B25B 13/463
2016/0271763 A1 * 9/2016 Su ..... B25B 13/463

* cited by examiner

*Primary Examiner* — Hadi Shakeri
(74) *Attorney, Agent, or Firm* — Rosenberg, Klein & Lee

(57) ABSTRACT

A wrench includes a handle and a driving head and a ratchet ring with a receiving hole is received in the driving head. An adapter is detachably inserted into the receiving hole and has a neck, an engaging portion and a reception hole. The neck on first end of the engaging portion has a first groove. A second groove is defined in the second end of the engaging portion. Multiple holes are defined through the bottom of the second groove and communicate with the reception hole. 33 A clip is engaged with the second groove and partially protrudes beyond the holes and exposed in the reception. A securing unit is connected to the driving head to secure or release the adapter. The receiving hole is connected with larger bits or sockets, and the adapter is connected with smaller bits or sockets.

2 Claims, 10 Drawing Sheets

SECURING UNIT FOR SECURING ADAPTER TO WRENCH

BACKGROUND OF THE INVENTION

1. Fields of the Invention

The present invention relates to a wrench, and more particularly, to a securing unit for securing an adapter to the wrench so as to be cooperated with bits and sockets of different sizes.

2. Descriptions of Related Art

There are many types of hand tools of different functions to meet different tasks, such as ratchet wrenches, screwdrivers, and pliers. In other words, the users have to carry many tools in the tool boxes to the work areas. The hand tools are heavy and occupy space, and it is inconvenient to carry so many tools to climb up and down. Besides, different hand tools have different functions, and there are other parts to be cooperated with, such as bits and sockets which has different sizes as well. The users have to prepare wrenches of different sizes so as to be connected with the bits and sockets.

The present invention intends to provide a wrench that includes a securing unit which secures and releases an adapter, and the wrench is able to be cooperated with different bits and sockets with or without the adapter.

SUMMARY OF THE INVENTION

The present invention relates to a wrench and a handle and a driving head which has a ratchet ring installed therein. The ratchet ring has a receiving hole. An adapter is detachably inserted into the receiving hole and has a neck, an engaging portion and a reception hole which is defined through the neck and the engaging portion. A first groove is defined in the outside of the neck which extends from the first end of the engaging portion. A second groove is defined in the outside of the second end of the engaging portion. Multiple holes are defined through the bottom of the second groove and communicate with the reception hole. A clip is engaged with the second groove and partially protrude beyond the holes and is exposed in the reception hole. A securing unit is connected to the driving head and secures or releases the adapter relative to the receiving hole. The securing unit is removably engaged with the first groove in the receiving hole.

Preferably, the receiving hole of the ratchet ring is a polygonal hole and the engaging portion of the adapter is a polygonal portion.

Preferably, a shoulder extends inward and radially from the inner periphery of the reception hole of the adapter. The shoulder is located corresponding to the neck so as to be adapted to stop a bit or a socket in the reception hole.

Preferably, the adapter includes a protrusion formed on the second end thereof. The second groove is defined in the protrusion.

Preferably, the securing unit has a shifter and a spring. The driving head has a slot in which the shifter is inserted. The first end of the shifter is located beyond the slot and the second end of the shifter is inserted into the receiving hole. A pin extends through the second end of the shifter and the slot to pivotably connected the shifter to the driving head. The driving head has a first recess. The second end of the shifter has a second recess which is located corresponding to the first recess. The spring is received between the first and second recesses. When pivoting the shifter, the spring is compressed so that the second end of the shifter is disengaged from the first groove of the adapter so that the adapter is removed from the driving head. When the shifter is not pivoted, the spring is not compressed so that the second end of the shifter is engaged with the first groove of the adapter so that the adapter is secured in the driving head.

The primary object of the present invention is to provide a wrench which is cooperated with larger bits or sockets when the adapter is detached from the driving head. When the adapter is connected to the driving head, smaller bits or sockets are able to be connected to the adapter.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
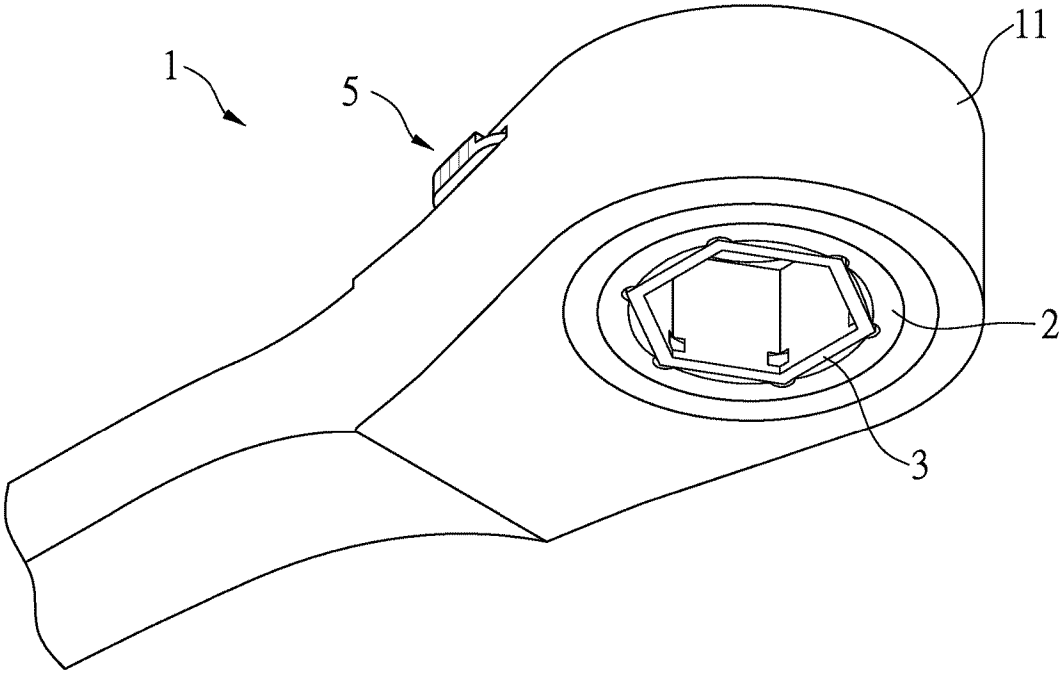
FIG. 1 is a perspective view to show the wrench of the present invention.

Referring to FIGS. 1 to 6, the wrench 1 of the present invention comprises a handle and a driving head 11 which has a ratchet ring 2 installed therein. The ratchet ring 2 has a receiving hole 21 which is a polygonal hole so as to be engaged with a bit 20 or a socket 10 therein.

An adapter 3 detachably inserted into the receiving hole 21 and two ends of the adapter 3 are in flush with two sides of the driving head 11. The adapter has a neck 31, an engaging portion 32 and a reception hole 33 which is defined through the neck 31 and the engaging portion 32. A first groove 311 is defined in the outside of the neck 31 which extends from the first end of the engaging portion 32. A second groove 321 is defined in the outside of the second end of the engaging portion 32. Multiple holes 322 are defined through the bottom of the second groove 321 and communicate with the reception hole 33. The engaging portion 32 of the adapter 3 is a polygonal portion which is shaped to be received in the receiving hole 21.

A clip 4 which is a C-lip is engaged with the second groove 321 and partially protrudes beyond the holes 322 and exposed in the reception hole 33. A securing unit 5 is connected to the driving head 11 and secures or releases the adapter 3 relative to the receiving hole 21. The securing unit 5 is removably engaged with the first groove 311 in the receiving hole 21.

It is noted that the reception hole 33 of the adapter 3 is a polygonal hole which is designed to be connected to a bit 20 or a socket 10 that is smaller than the bit 20 or the socket 10 suitable for being connected to the receiving hole 21 of the driving head 11.

The users carry the wrench 1 and the bits 20 and sockets 10 needed, when the larger bits 20 and socket 10 are needed, the adapter 3 is removed from the wrench 1, and the larger bits 20 and socket 10 are directly connected to the receiving hole 21 of the driving head 11. Alternatively, when the smaller bits 20 and socket 10 are to be used, they are connected to reception hole 33 of the adapter 3.

Figure 5:
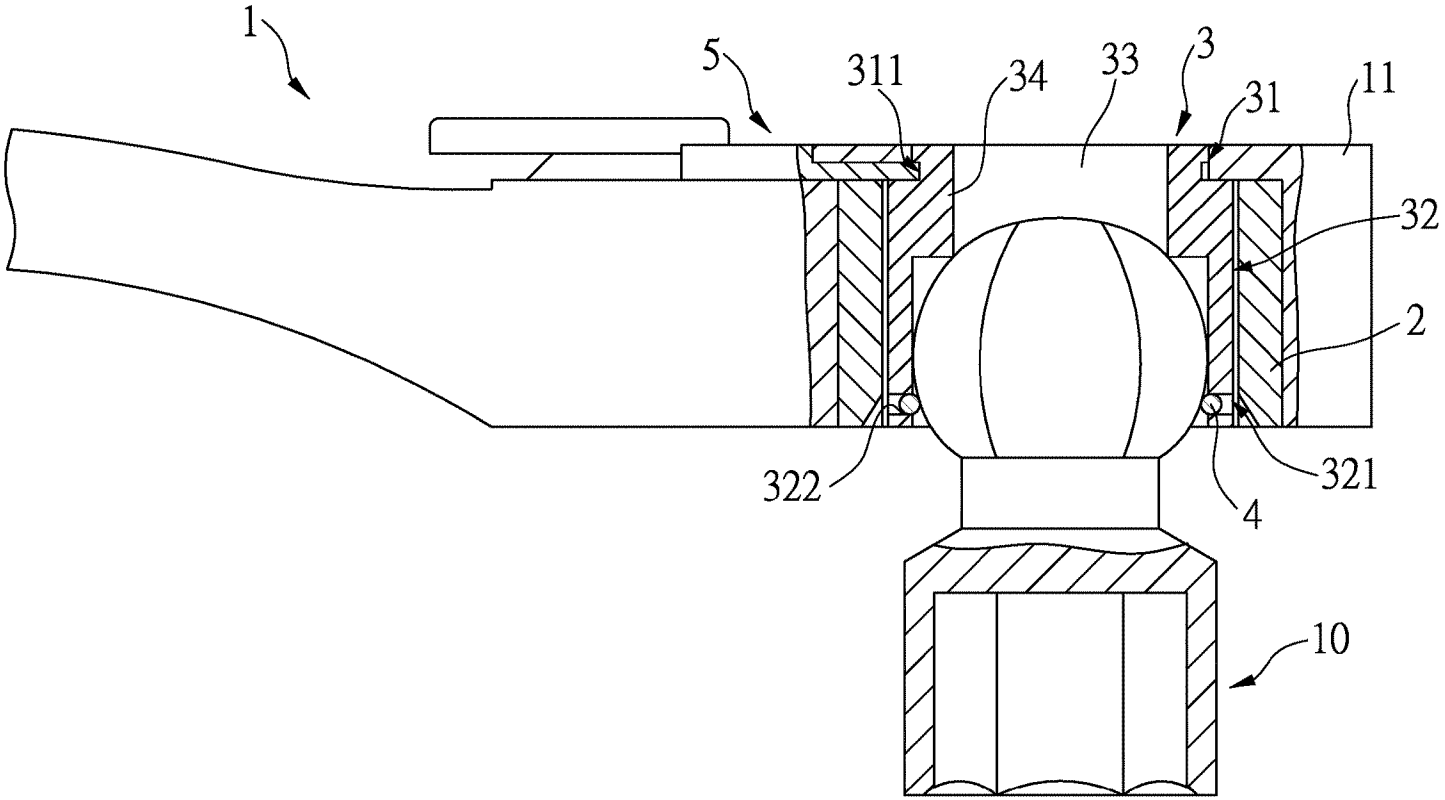
FIG. 5 is a cross sectional view of the combination disclosed in FIG. 3.
Figure 6:
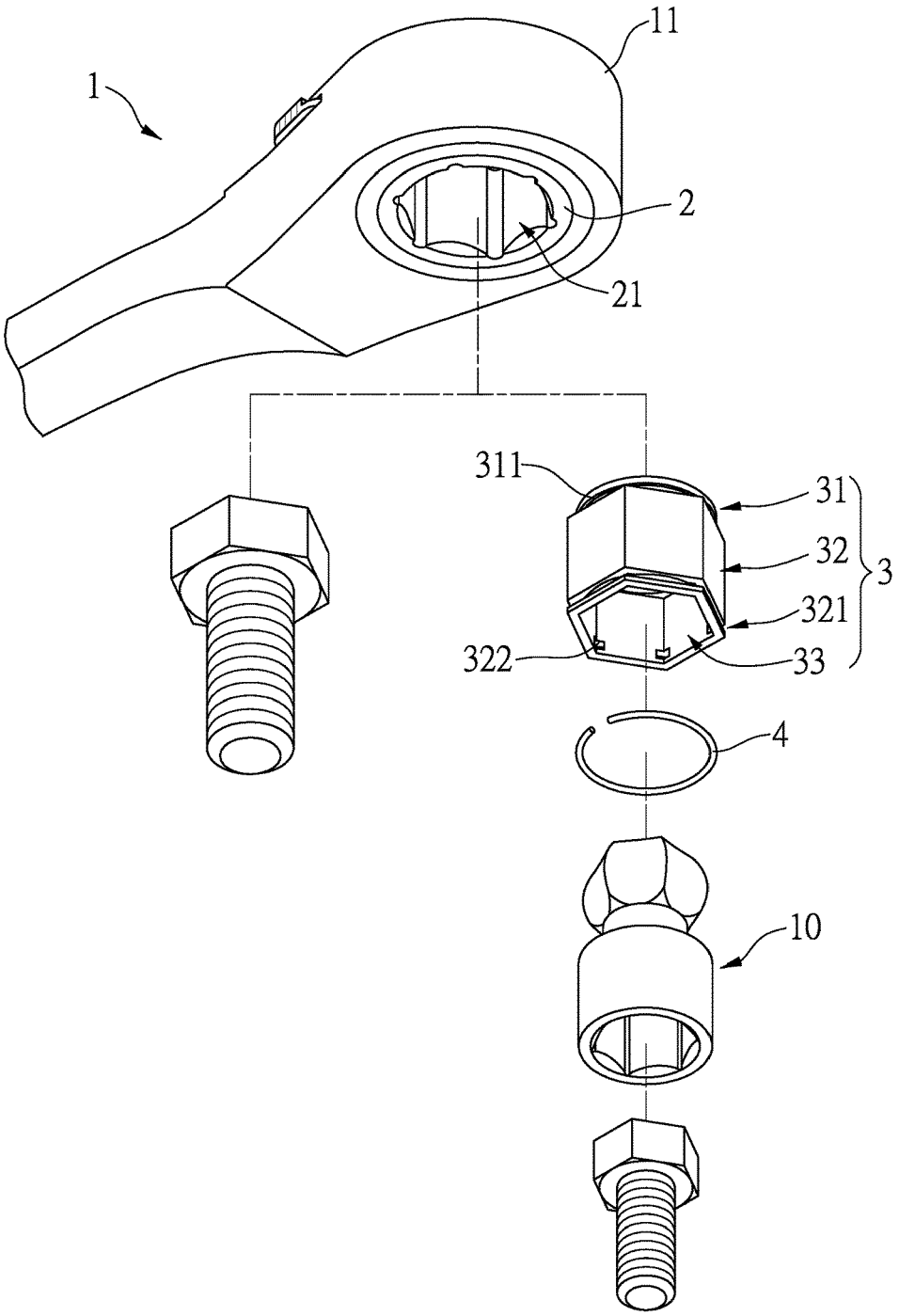
FIG. 6 shows that the wrench is able to be connected with two bolts of different sizes.

As shown in FIG. 5, a shoulder 34 extends inward and radially from the inner periphery of the reception hole 33 of the adapter 3. The shoulder 34 is located corresponding to the neck 31 so as to stop the bit 20 or the socket 10 in the reception hole 33. In other words, the depth that the bit 20 or the socket 10 that is inserted into the reception hole 33 is restricted. The portion of the clip 4 that exposed from the holes 322 and is located within the reception hole 33 also contacts the spherical portion of the socket 10 to position the socket 10.

Figure 7:
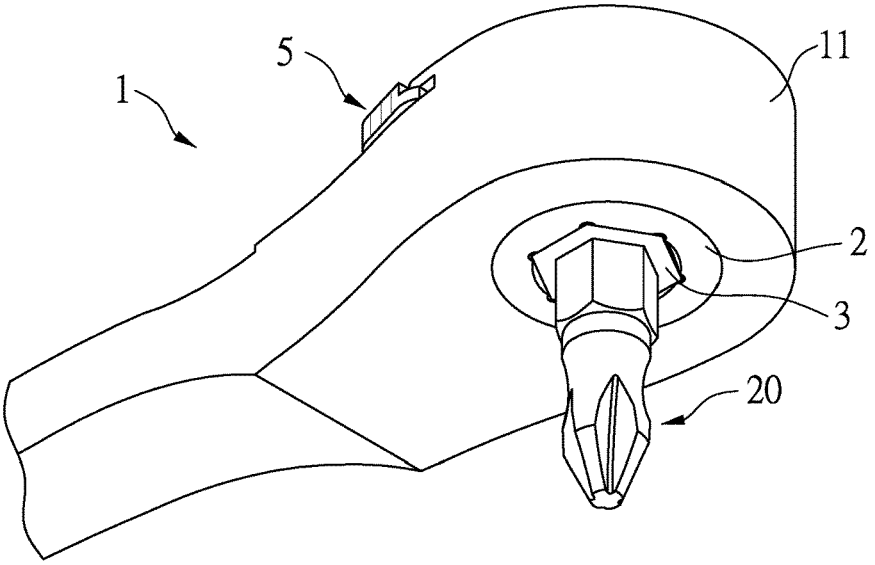
FIG. 7 is a perspective view to show the second embodiment of the wrench of the present invention.
Figure 8:
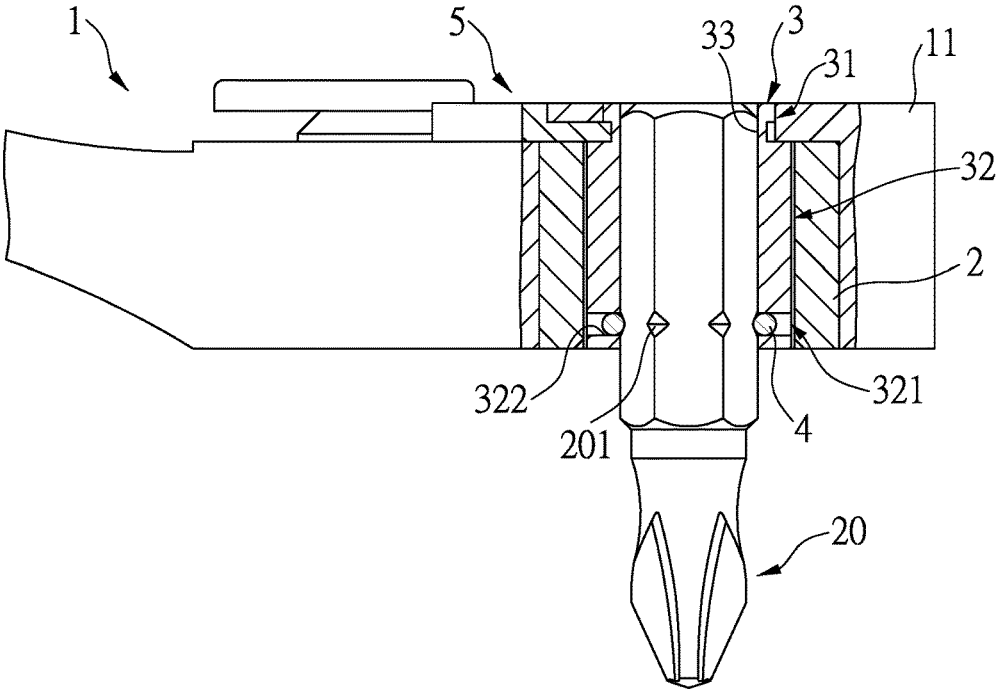
FIG. 8 is a cross sectional view to show the second embodiment of the wrench of the present invention.

As shown in FIGS. 7 and 8, the reception hole 33 of the adapter 3 is shaped and sized to be connected with the bit 20 of smaller size. When the bit 20 is inserted into the reception hole 33 of the adapter 3, the portion of the clip 4 that exposed from the holes 322 and is located within the reception hole 33 is engaged with the notches 201 of the bit 20 to position the bit 20.

Figure 9:
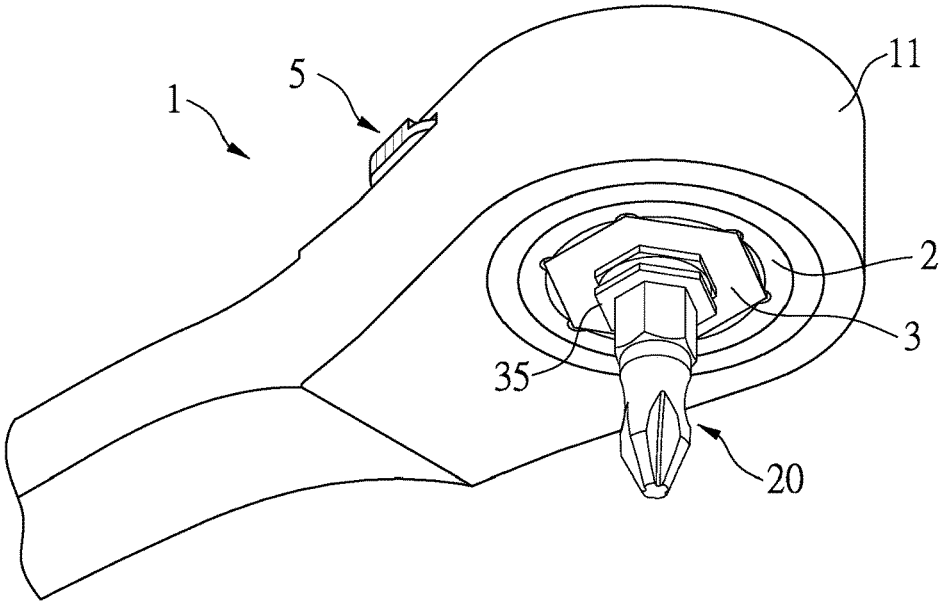
FIG. 9 is a perspective view to show the third embodiment of the wrench of the present invention.
Figure 10:
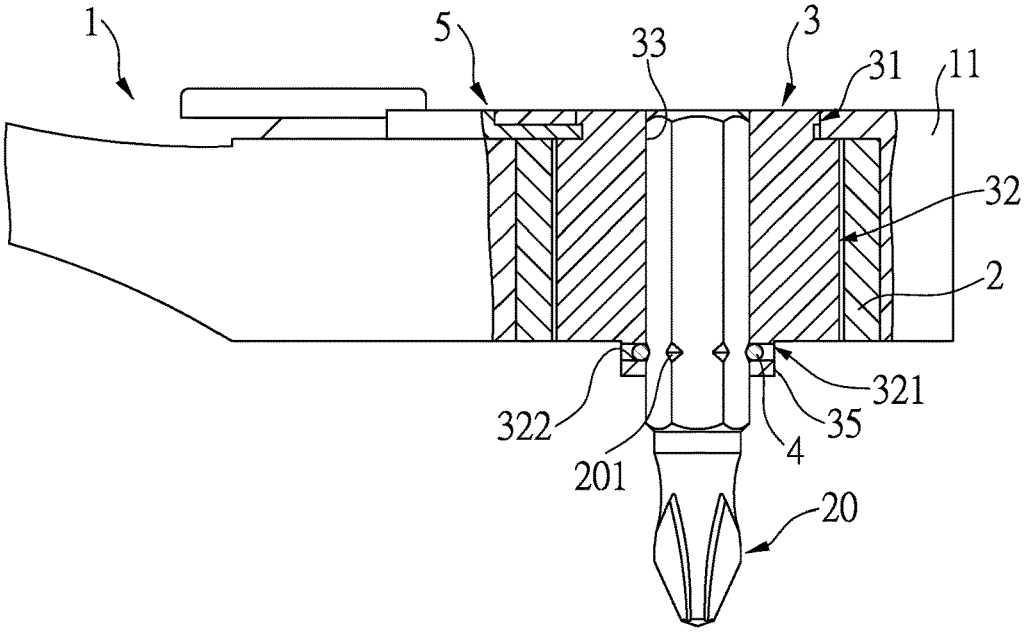
FIG. 10 is a cross sectional view to show the third embodiment of the wrench of the present invention.

As shown in FIGS. 9 and 10, the adapter 3 includes a protrusion 35 formed on the second end thereof, and the second groove 321 is defined in the protrusion 35. This embodiment is designed to be cooperated with a longer bit 20, and the portion of the clip 4 that exposed from the holes 322 and is located within the reception hole 33 is engaged with the notches 201 of the bit 20 to position the bit 20.

Figure 11:
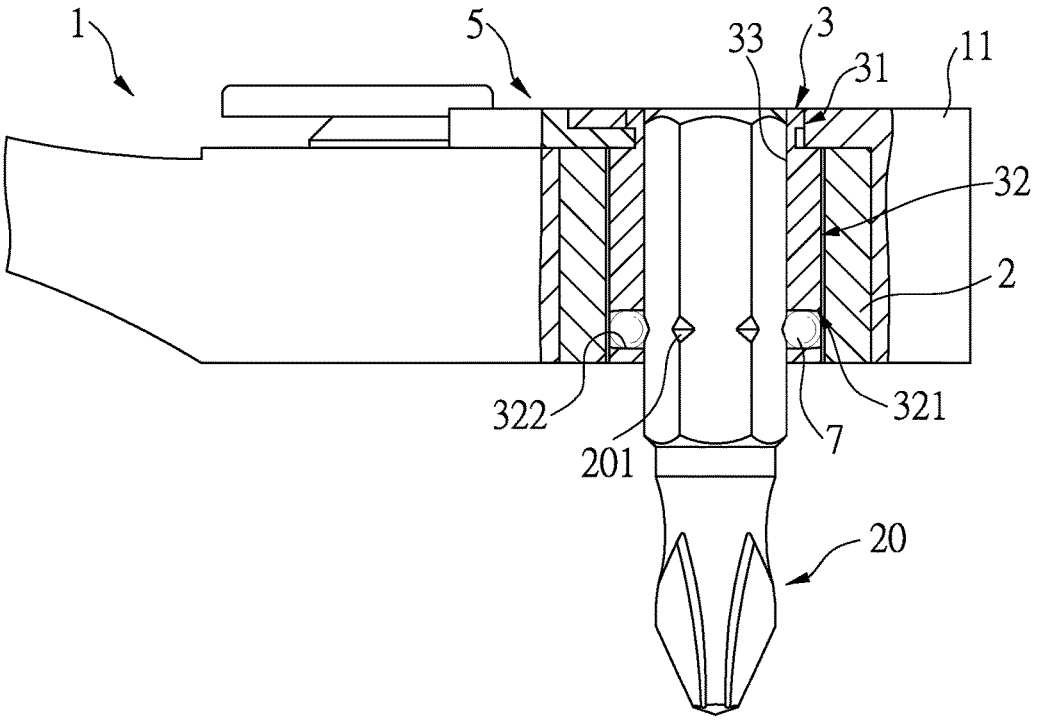
FIG. 11 is a cross sectional view to show the fourth embodiment of the wrench of the present invention.

As shown in FIG. 11, the embodiment shows that the clip 4 is replaced by a bead 7 which performs the same function as the clip 4.

Figure 2:
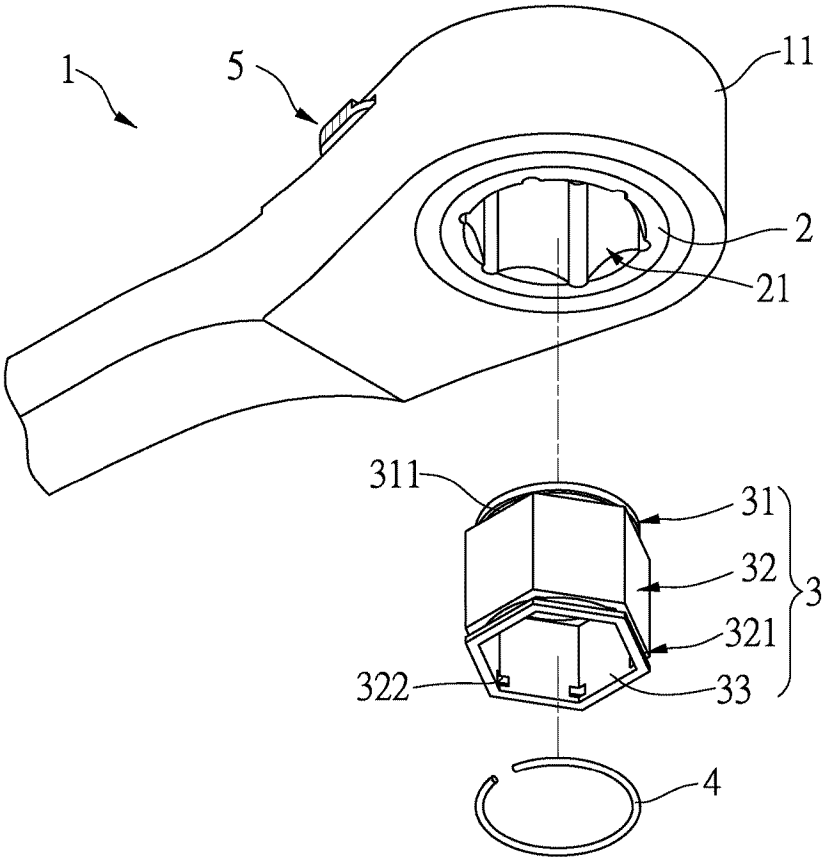
FIG. 2 is an exploded view to show the adapter and the driving head of the wrench of the present invention.
Figure 3:
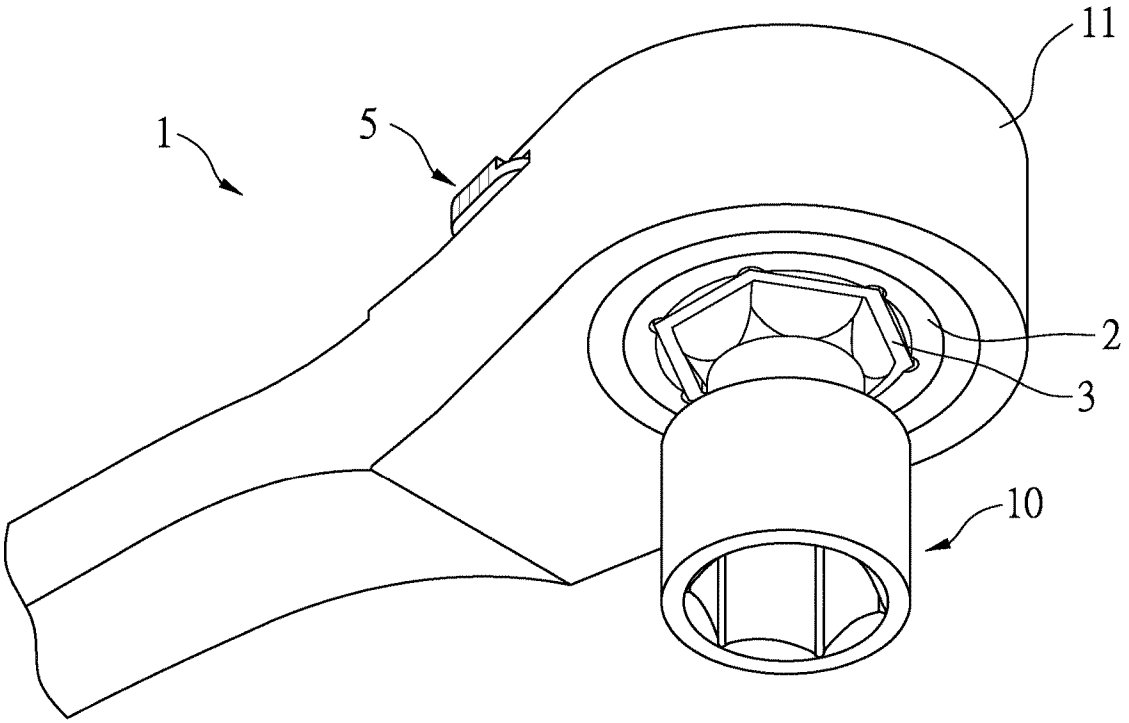
FIG. 3 shows a socket is connected to the adapter on the wrench of the present invention.
Figure 4:
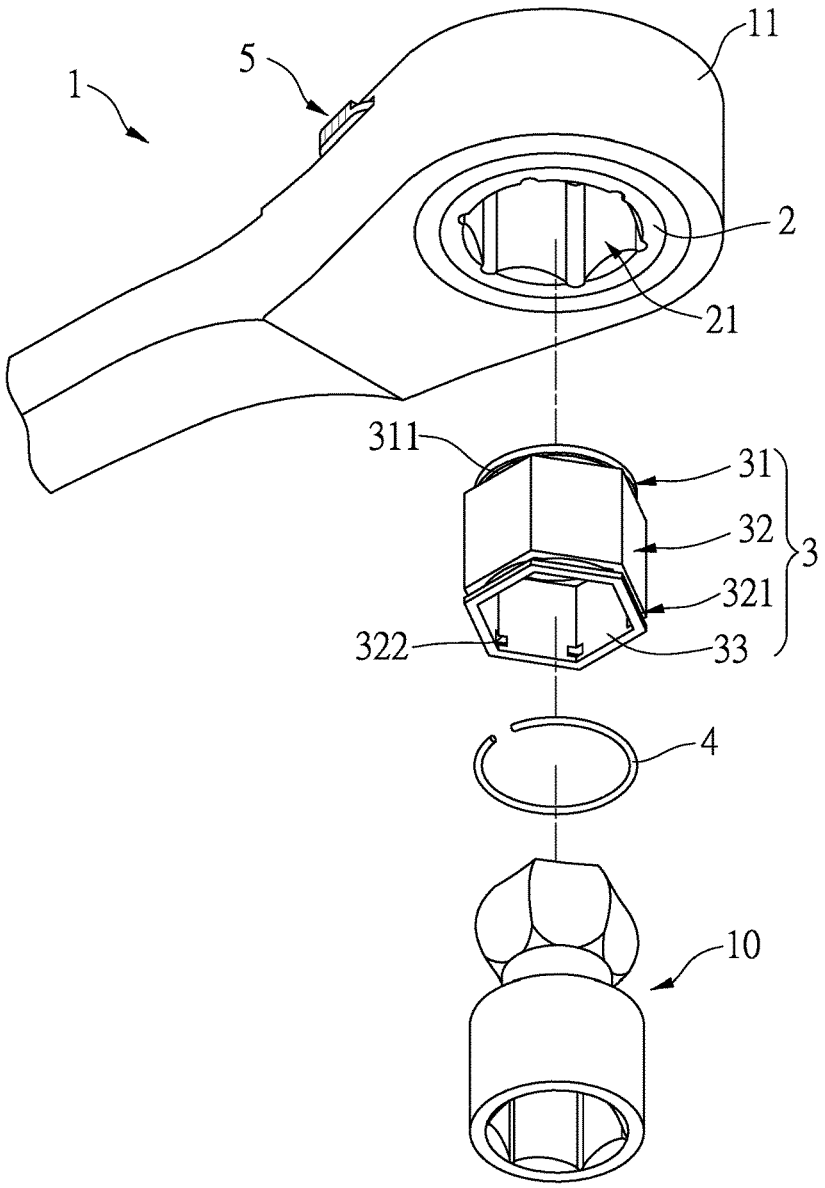
FIG. 4 is an exploded view to show the socket and the wrench of the present invention.

As shown in FIG. 2, the engaging portion 32 of the adapter 3 has the same shape as the receiving hole 21 so that when the adapter 3 is inserted into the receiving hole 21 and the wrench 1 is rotated, the adapter 3 is rotated with the wrench 1.

Figure 12:
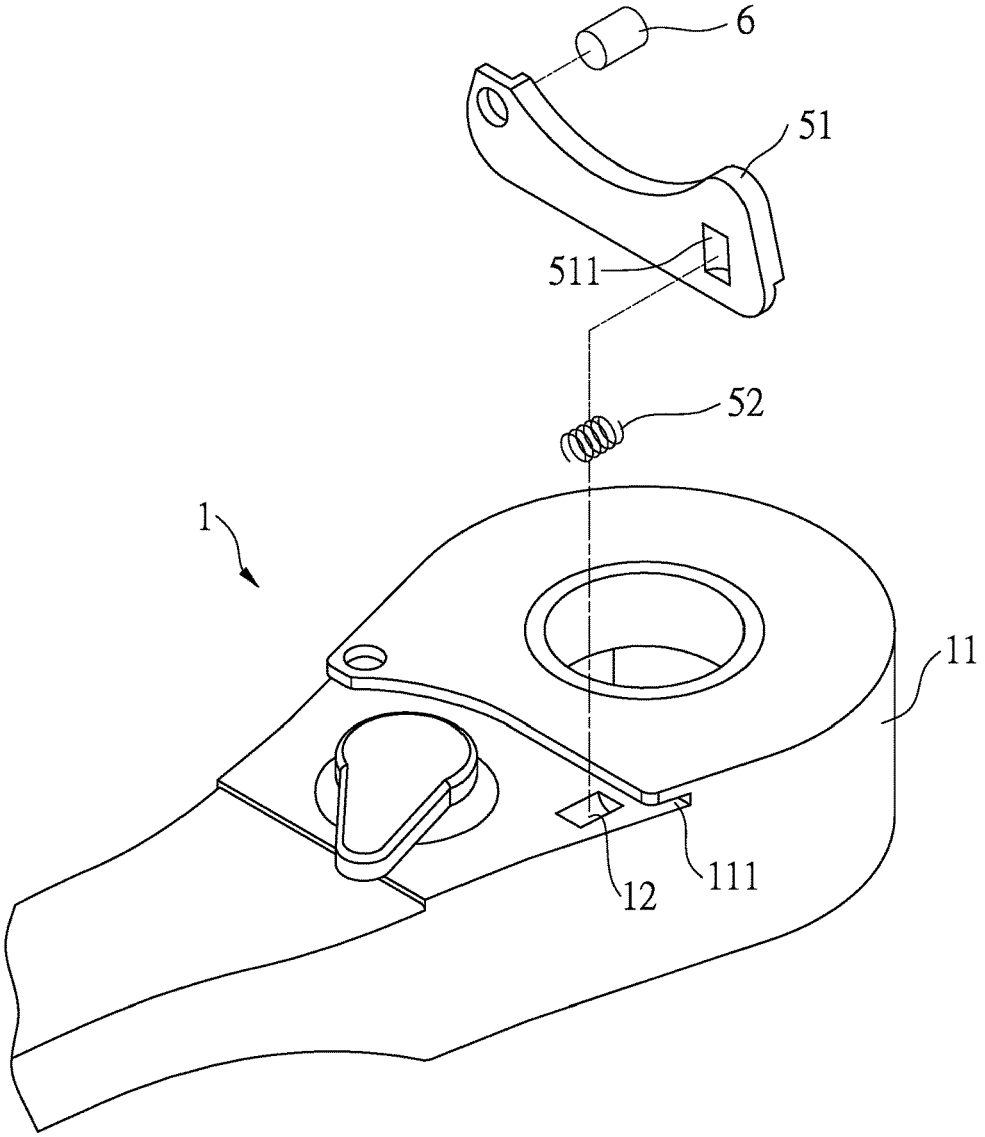
FIG. 12 is an exploded view to show the securing unit of wrench of the present invention.

As shown in FIG. 12, the securing unit 5 has a shifter 51 and a spring 52. The driving head 11 has a slot 111 in which the shifter 51 is inserted. The first end of the shifter 51 is located beyond the slot 111 and a pin 6 extends through a second end of the shifter 51 and the slot 111 to pivotably connect the shifter 51 to the driving head 11. The driving head 11 has a first recess 12, and the first end of the shifter 51 has a second recess 511 which is located corresponding to the first recess 12. The spring 52 is received between the first and second recesses 12, 511. When pivoting the shifter 51, the spring 52 is compressed and the first end of the shifter 51 is disengaged from the first groove 311 of the adapter 3 so that the adapter 3 is removed from the driving head 11.

When the shifter 51 is not pivoted, the spring 52 is not compressed so that the first end of the shifter 51 is engaged with the first groove 311 of the adapter 3 so that the adapter 3 is secured in the driving head 11.

The wrench 1 is connected to the adapter 3 and able to be cooperated with bits 20 and sockets 10 of different sizes.

While we have shown and described the embodiment in accordance with the present invention, it should be clear to those skilled in the art that further embodiments may be made without departing from the scope of the present invention.

What is claimed is:

1. A wrench comprising:

a handle and a driving head which has a ratchet ring installed therein, the ratchet ring having a receiving hole, which is a is a polygonal hole;

an adapter detachably inserted into the receiving hole and having a neck, an engaging portion and a reception hole defined through the neck and the engaging portion, the engaging portion of the adapter being a polygonal portion, a first groove defined in an outside of the neck which extends from a first end of the engaging portion, a second groove defined in an outside of a second end of the engaging portion, multiple holes defined through a bottom of the second groove and communicating with the reception hole, a shoulder extending inward and radially from an inner periphery of the reception hole of the adapter, the shoulder located corresponding to the neck so as to be adapted to stop a bit or a socket in the reception hole;

a clip engaged with the second groove and partially protruding beyond the holes and exposed in the reception hole, and a securing unit connected to the driving head and securing or releasing the adapter relative to the receiving hole, the securing unit having a shifter and a spring, the driving head having a slot in which the shifter is inserted, a first end of the shifter located beyond the slot and a second end of the shifter pivotably connected to the driving head, the first end of the shifter inserted into the receiving hole and engaged with the first groove of the adapter, the driving head having a first recess, the first end of the shifter having a second recess which is located corresponding to the first recess, the spring received between the first and second recesses, wherein when pivoting the shifter, the spring is compressed so that the first end of the shifter is disengaged from the first groove of the adapter so that the adapter is removed from the driving head, wherein when the shifter is not pivoted, the spring is not compressed so that the first end of the shifter is engaged with the first groove of the adapter so that the adapter is secured in the driving head.

2. The wrench as claimed in claim 1, wherein the adapter includes a protrusion formed on the second end thereof, the second groove is defined in the protrusion.

* * * * *